US006796449B2

(12) United States Patent
Fragola

(10) Patent No.: US 6,796,449 B2
(45) Date of Patent: Sep. 28, 2004

(54) CLOSURE FOR CONTAINERS, IN PARTICULAR PLUG FOR BOTTLES

(75) Inventor: Felice Fragola, Alessandria (IT)

(73) Assignee: Guala Dispensing S.p.A., Alessandria (IT)

( * ) Notice: Subject to any disclaimer, the term of this patent is extended or adjusted under 35 U.S.C. 154(b) by 55 days.

(21) Appl. No.: 09/937,709

(22) PCT Filed: Jan. 22, 2001

(86) PCT No.: PCT/EP01/00566

§ 371 (c)(1),
(2), (4) Date: Oct. 1, 2001

(87) PCT Pub. No.: WO01/58772

PCT Pub. Date: Aug. 16, 2001

(65) Prior Publication Data

US 2002/0153342 A1 Oct. 24, 2002

(30) Foreign Application Priority Data

Feb. 7, 2000 (IT) ..... TO2000A0112

(51) Int. Cl.[7] ..... A65D 39/00

(52) U.S. Cl. ..... 215/364; 220/DIG. 19; 217/110

(58) Field of Search ..... 215/364, 355, 215/356–360, 294, 296, 297, 320; 220/DIG. 19, 800–802, 789, 790; 217/110

(56) References Cited

U.S. PATENT DOCUMENTS

| | | | | | |
|---|---|---|---|---|---|
| 34,227 | A | * | 1/1862 | Ames | 215/364 |
| 368,959 | A | * | 8/1887 | Morehouse | 215/364 |
| 623,070 | A | * | 4/1899 | Bonwick | 215/364 |
| 700,043 | A | * | 5/1902 | Heard | 215/360 |
| 706,634 | A | * | 8/1902 | Blumer | 215/364 |
| 1,146,036 | A | * | 7/1915 | Spinks | 215/360 |
| 4,572,390 | A | * | 2/1986 | Grittmann | 217/106 |
| 4,812,317 | A | * | 3/1989 | Taylor | 426/87 |
| 5,279,606 | A | * | 1/1994 | Haber et al. | 604/403 |
| 5,636,757 | A | * | 6/1997 | Porvaznik | 215/364 |
| 5,710,184 | A | * | 1/1998 | Burns | 521/50 |
| 5,904,965 | A | * | 5/1999 | Noel et al. | 428/36.5 |
| 6,202,878 | B1 | * | 3/2001 | Cook | 220/255 |
| 6,221,451 | B1 | * | 4/2001 | Lauer et al. | 428/36.5 |
| 6,455,424 | B1 | * | 9/2002 | McTeer et al. | 438/675 |

FOREIGN PATENT DOCUMENTS

| | | | | |
|---|---|---|---|---|
| EP | 0 166 036 | | 1/1986 | |
| EP | 532367 | * | 3/1993 | 215/364 |
| EP | 0 629 559 | | 12/1994 | |
| EP | 0 894 730 | | 2/1999 | |
| FR | 1 100 579 | | 9/1955 | |
| FR | 2 644 142 | | 9/1990 | |

* cited by examiner

*Primary Examiner*—Lien T M Ngo
(74) *Attorney, Agent, or Firm*—Nixon & Vanderhye, P.C.; Frank P. Presta

(57) ABSTRACT

A closure for containers having an opening, comprising substantially rigid supporting and sealing means for insertion in a container opening, and a covering body made of flexible and resilient plastic material which covers at least a portion of and is connected to the supporting and sealing means, and is adapted to close the container opening. The supporting and sealing means comprise an upper and lower support and sealing element operatively joined together to support the covering body in a longitudinal direction to prevent elongation of the plastic material of the covering body.

19 Claims, 12 Drawing Sheets

CLOSURE FOR CONTAINERS, IN PARTICULAR PLUG FOR BOTTLES

The present invention refers in general to a closure for containers, and in particular to a plug for bottles, preferably adapted to be used to plug bottles of wine.

Due to its preferred application as currently provided, the following description will be oriented to the case in which the closure of the invention is applied to the field of bottles for foodstuff, in particular of bottles of wine, so that the closure will assume the configuration of a bottle plug. It is clear, however, that the teachings of the present invention are equally applicable to containers for any type of substance (foodstuff or otherwise) that needs a sealed closure capable on one hand of preventing the contained substance from leaking out, and on the other hand of preventing gases and/or foreign substances (including, for example, the material of which the closure is composed) from entering inside the container.

In the field of plugs for bottles of wine, the most common material of which they are made is cork: such material is costly, increasingly difficult to obtain, since it comes from specific plants and therefore is available in nature in relatively limited amounts.

Moreover, plugs made of cork have many problems from the functionality point of view: studies in the field have demonstrated that in high percentages such plugs damage the wine contained in the bottles, giving it a taste that is no longer the original one and that is always unpleasant to the palate. When the wine contained in these bottles is precious, the presence of a faulty plug is wasteful and implies heavy costs.

Even when plugs made of cork do not show defects, it is advisable to periodically replace them (10–15 years), to avoid spoiling the bottle contents.

Cork also gives rise to problems in terms of its installation and removal from bottles: in fact, automatic plugging machines are exposed to dust and pieces of cork that become detached, polluting the environment and impairing process quality; moreover, cork is a non-uniform material, so that its behaviour differs from one supply batch to the next; finally, when the plug is removed from a bottle, for example using an ordinary corkscrew, it can happen that small bits of cork fall inside the bottle itself and pollute its contents.

Studies are being carried out to produce plugs for bottles made of plastic material that provide equivalent performances to those of plugs made of cork without the abovementioned problems, but the practical results so far are unsatisfactory in various aspects, so that it has not yet been possible to produce a closure that allows the replacement of cork as material (even with all problems generated thereby, as mentioned above), while providing the same positive characteristics.

The object of the present invention is to solve the abovementioned problems of the prior art by providing a closure made of plastic material for containers that has optimum sealing characteristics, preventing gases and/or foreign substances from entering inside the containers and preventing the substance contained in the containers themselves from leaking out.

A further object of the present invention is to provide a closure of the wine bottle plug type that can be applied to the bottle neck sizes that are currently deemed as standard for bottles of this type, that can be adapted without modifications to the automated machinery for plugging bottles themselves and that can be removed from bottles using ordinary removing means of the corkscrew type. Moreover, the plug of the invention allows the organoleptic characteristics of the wine contained to be preserved, and therefore it finds a preferred application in the storage of wines of the still and lightly sparkling types, and in the storage of precious wines.

The above and other objects and advantages of the invention, as will appear from the following description, are obtained by a closure for containers as claimed in claim 1. Preferred embodiments and nonobvious variations of the present invention are claimed in the dependent claims.

The present invention will be better described by some preferred embodiments thereof, given by way of non-limiting examples, with reference to the attached drawings, in which.

With reference to the figures, the closure for containers according to the invention will be described hereinbelow. As can be seen from the figures and as will clearly appear from the following description, numerous constructive variations of the closure are possible, all having in common the characteristics claimed in the claims. It will be obvious for the persons skilled in the art, therefore, that the embodiments shown and described are only examples and do not limit the scope of the invention that is defined by the attached claims.

Figure 1:
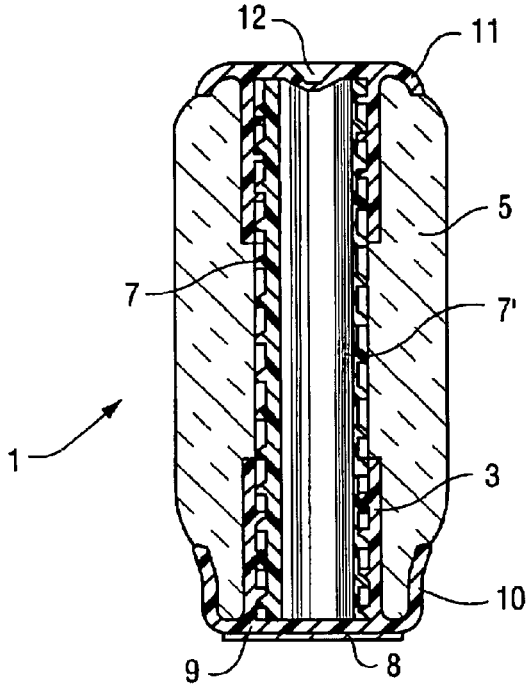
FIG. 1 is a side cross-sectional view of a first embodiment of a closure for containers according to the present invention.
Figure 2:
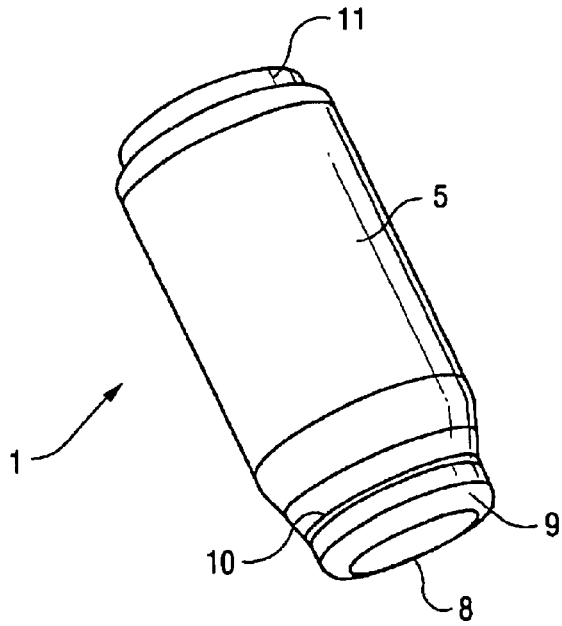
FIG. 2 is a perspective view of the supporting and sealing means of the closure in FIG. 1.

In general, as can be seen from the figures, the closure for containers of the invention comprises substantially rigid supporting and sealing means 3 and a covering body 5 (commonly, but norm a limiting way, placed externally with respect to the supporting and sealing means 3) made of plastic material (commonly, but not in a limiting way, elastomeric material): the covering body 5 in FIG. 1 is placed around the supporting and sealing means 3 in order to assume, for example, the external cylindrical shape of a bottle plug (FIG. 2). The dimensions of the covering body 5 are such as to allow it to be inserted into a traditional bottle neck (not shown) and then to cooperate with the internal walls thereof, due to the elastomeric material of which the plug 1 is made, to guarantee a perfect seal for the substance contained inside the bottle. The covering body 5 in practice cooperates by interference with the container opening to prevent the material contained therein from leaking out and to prevent gases and/or foreign substances from entering inside the container itself. The supporting and sealing means 3 are useful both for supporting the closure 1 in a longitudinal direction, and for strengthening the seal thereof with the container at or more points. The supporting and sealing means 3 are important, since the elastomeric material could in time elongate and partly impair the sealing functionality: this is prevented by the means 3 above all in the part of the closure 1 facing the container interior.

According to a preferred embodiment of the invention, the covering body 5 is made of thermoplastic foam material, or of thermosetting foam material.

According to another preferred embodiment of the invention, the covering body 5 may alternatively be made of crosslinked foam material, of the commonly marketed types such as APO (marketed by the company API). Obviously, other materials with equivalent functionalities, that will become available in the art in the future, can be used.

If the material employed is a foam elastomer, the manufacturing process must include hot molding in the presence of a blowing agent which may be of chemical or physical type and is selected from those usually used in analogous processes. However, a particularly preferred process for hot-molding the closure (1) uses a fluid in the supercritical state as a blowing agent. As is known, a fluid in the supercritical state is a fluid maintained at a pressure and temperature above that material's critical pressure and temperature and therefore behaves in ways characteristic of both a liquid and a gas. For example, this fluid will have a solvent power similar to that of a liquid, but a surface tension much weaker than that of a liquid and such as to increase its diffusion through the solute.

The method according to the present invention involves the following steps:

(a) providing a source of supercritical fluid at a temperature and pressure greater than the critical temperature and pressure of that supercritical fluid;

(b) preheating the polymer material to a temperature above the supercritical fluid's critical temperature, preferably above the softening or melting temperature of this polymer material;

(c) saturating the polymer material that was preheated in step (b) with the supercritical fluid by maintaining the interior of the saturation chamber at a temperature and pressure greater than the critical temperature and pressure of the supercritical fluid, said preheated polymer material and said supercritical fluid preferably being mixed in said saturation chamber in order to facilitate the saturation process;

(d) injecting said preheated polymer material saturated with the supercritical fluid into a closure mold, reducing the pressure to below the critical pressure of the supercritical fluid;

(e) and maintaining said polymer material in the mold until formation of the closure is complete.

The preferred supercritical fluid for the process outlined above is nitrogen in the supercritical state, for which the critical temperature and pressure are, respectively, T=−147° C. approx. and $P=3.389\times10^6$ N/m$^2$ approx.

The process outlined above is particularly advantageous as we have observed that it produces a material with an extremely homogeneous structure of minute microcells (from $10^9$ to $10^{12}$ cells per cm$^3$, the mean size of the cells being less than 2 microns). The closure therefore acquires remarkable sealing properties and properties of impermeability to gases.

In the abovementioned practical embodiments, the closure 1 of the invention in its shape as a plug is therefore adapted to be placed in a bottle, in order to close it, using an ordinary plugging machine (not shown), and is adapted to be removed from a bottle, when opening, using an ordinary corkscrew (not shown). The material of which the plug 1 is composed guarantees barrier characteristics and characteristics ensuring a lack of material leakage for a period that is not less than the one that can be obtained with a plug made of cork under optimum conditions.

In order to perform the abovementioned barrier function, the closure 1 of the invention may be further equipped with barrier means 8, for example in the form of at least one circular thin layer placed on the side of the closure 1 facing the container interior; said thin layer is made of a material suitable for forming such a barrier, for example even gold. Other types of barrier means could be at least one disk or at least one washer, for example made of glass for better storage of the product inside the container.

According to a first preferred embodiment of the closure 1, shown in FIGS. 1 and 2, the supporting and sealing means 3 are composed of a threaded hollow fitting 7, that extends substantially along the whole length of the closure 1; the fitting 7 is connected to at least one lower support 9 and at least one upper support 11. The connection between the fitting 7 and the upper and lower supports 9 and 11 can occur by screwing, fixing by complementary shape or other known ways.

Figure 3:
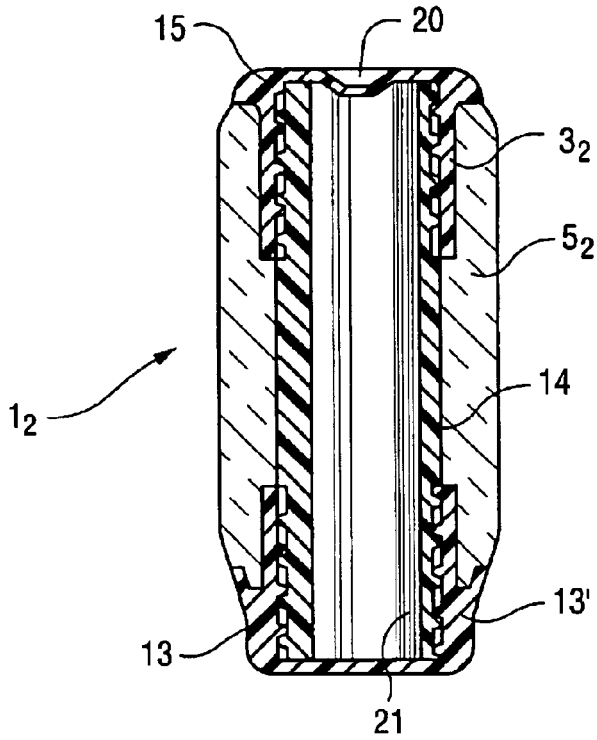
FIG. 3 is a side cross-sectional view of a second embodiment of a closure for containers according to the present invention.

The lower support 9 is adapted to be coupled by interference with the container opening walls to prevent gases from entering thereinto, while the upper support 11 is adapted, by means of the insertion recess 12, to allow insertion of a corkscrew into the closure 1 for the removal thereof, using, in order to engage the corkscrew, a plurality of longitudinal ribs 7'. The closure 1 of FIGS. 1 and 2 has the lower support 9 shaped (in 10) in order to support the covering body 5 that expands therein, and to simultaneously provide insertion means to insert the closure 1 inside the container opening (in this case According to a second preferred embodiment of the closure $\mathbf{1}_2$ of the invention, shown in FIG. 3, the supporting and sealing means $\mathbf{3}_2$ are composed of at least one lower threaded support 13 and at least one upper threaded support 15 that are screwed into corresponding recesses formed inside the covering body $5_2$ and that engage a hollow elongated support member 14.

The lower support 13 is adapted to be coupled by interference with the container opening to prevent gases from entering thereinto, while the upper support 15 is adapted, by means of an insertion recess 20, to allow insertion of a corkscrew into the closure $1_2$ for the removal thereof. Moreover, the elongated support member 14 is equipped with a plurality of longitudinal ribs 21 for engagement with the corkscrew when removing the plug $1_2$. Also in this case, the closure $1_2$ of FIG. 3 has the lower support 13 shaped (in 13') in order to support the covering body $5_2$ that expands inside it, and to simultaneously provide insertion means to insert the closure $1_2$ into the container opening (in this case the bottle neck).

In both the above-illustrated arrangements, the upper support (11 or 15 depending on the case) is further adapted to bear writing and/or other signs relating to the container contents, such as for example product name or manufacturer name, advertising messages, etc.

Figure 4:
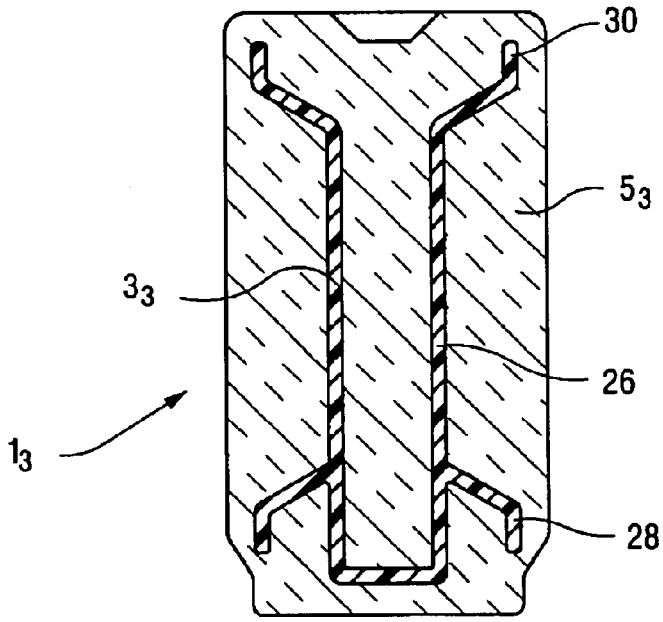
FIG. 4 is a side cross-sectional view of a third embodiment of a closure for containers according to the present invention.
Figure 5:
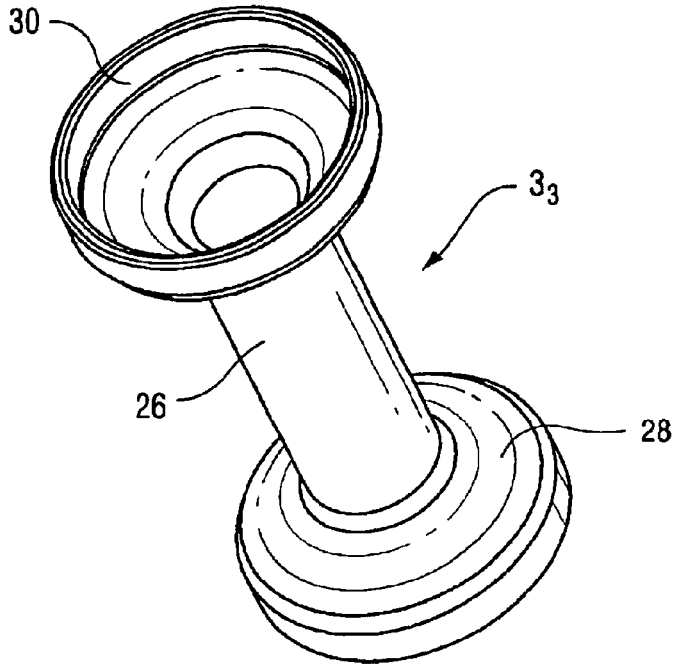
FIG. 5 is a perspective view of the closure in FIG. 4.

According to a third preferred embodiment of the closure $1_3$ of the invention, shown in FIGS. 4 and 5, the supporting and sealing means $3_3$ are composed of an elongated support body 26 that extends substantially along the whole length of the closure $1_3$; such elongated support body 26 is further equipped with at least one lower sealing member 28 adapted to guarantee sealing of the closure 1 against the container opening walls.

In the embodiment shown in FIGS. 4 and 5, the covering body $5_3$ is of cylindrical shape and the lower sealing member 28 is shaped as a frustum of a cone whose radius is less than the radius of the covering body $5_3$.

Always as shown in FIGS. 4 and 5, the elongated support body 26 is further equipped with at least one upper sealing member 30 adapted to improve sealing of the closure 1 against the container opening walls. The upper sealing member 30 is also shaped as a frustum of a cone whose radius is less than the radius of the covering body $5_3$ and is substantially identical to the radius of the lower sealing member 28.

Moreover, the elongated support body 26 is of cylindrical shape and is closed at the end thereof that is facing toward the container interior; this obviously serves to increase the sealing strength of the whole closure $1_3$, and can also be used during removal of the closure $1_3$ from the container to prevent, for example, the corkscrew from drilling right through the plug $1_3$, such operation being always inadvisable in the field.

Figure 6:
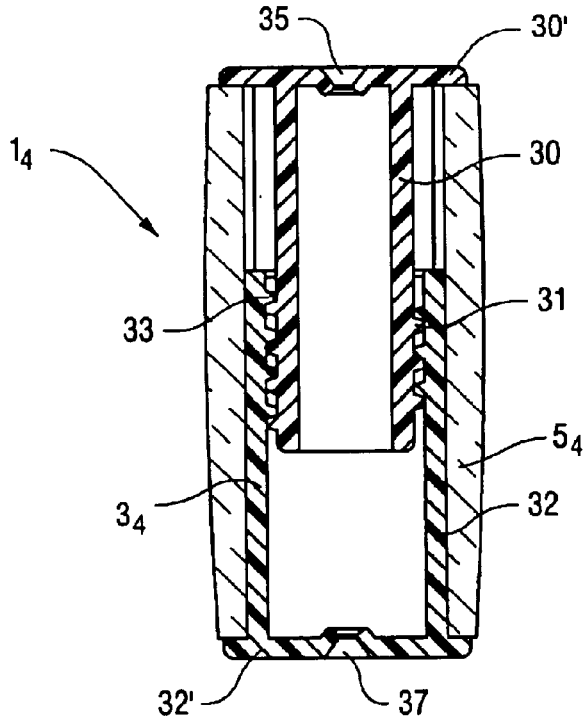
FIG. 6 is a side cross-sectional view of a fourth embodiment of a closure for containers according to the present invention.

According to a fourth preferred embodiment of the invention, shown in FIG. 6, the supporting and sealing means $3_4$ are composed of a first hollow member 30 whose cross section is "T"-shaped and a second hollow member 32, whose cross section is in the shape of an inverted "T", that is adapted to contain an end of the first hollow member 30 through threaded engagement of the respective ends 31 and 33 of the two members 30 and 32. The arrangement in FIG. 6 allows the closure $1_4$ to be used by orienting it and inserting it at will into the container, since both ends 30' and 32' of the supporting and sealing means $3_4$ have the same shape and are equipped with the recesses 35 and 37 for inserting the means for removing the closure $1_4$.

Figure 7:
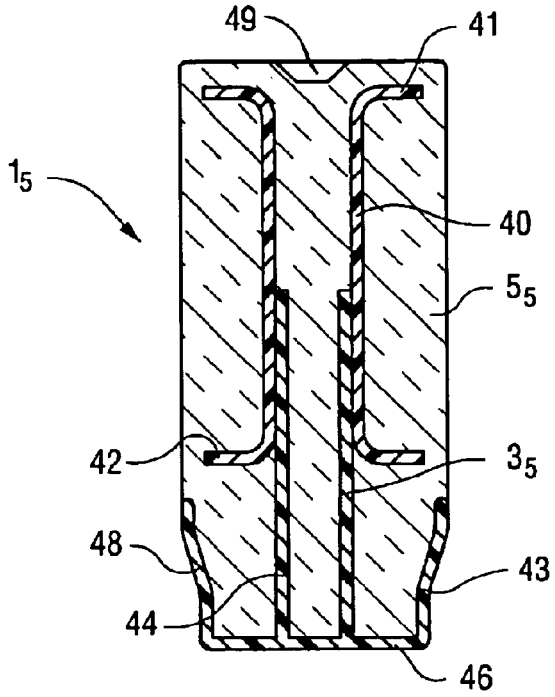
FIG. 7 is a side cross-sectional view of a fifth embodiment of a closure for containers according to the present invention.

According to a fifth preferred embodiment of the invention, shown in FIG. 7, the supporting and sealing means $3_5$ are composed of a cylindrically-shaped upper hollow member 40 open at both ends 41 and 42, in order to increase the seal against the container opening walls. The upper member 40 is placed above and outside a lower hollow member 43 that, in its central part 44, is shaped as an elongated cylinder that is inserted into the upper member 40, while in its part 46 facing toward the container interior it is shaped as a flat closure with insertion flarings 48 for insertion of the closure $1_5$ into the container. Once the upper member 40 and the lower member 43 have been coupled, they are surrounded by the covering body $5_5$ so that the plastic material of which this is composed penetrates into the spaces left empty due to coupling of the two members 40 and 43, and penetrates into the lower member 43 in such a way that its part 46, substantially performing the function of a barrier, is outside the covering body $5_5$. The recess 49 allowing penetration of the removing means into the closure $1_5$ is in this case directly formed in the covering body $5_5$.

Figure 8:
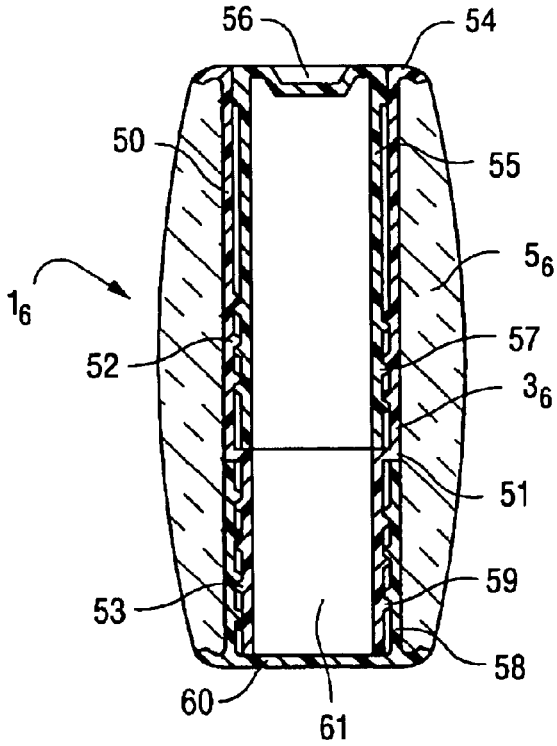
FIG. 8 is a side cross-sectional view of a sixth embodiment of a closure for containers according to the present invention.

According to a sixth preferred embodiment of the invention, shown in FIG. 8, the supporting and sealing means $3_6$ are composed of three mutually coupled internal hollow members, in which the first internal hollow member 50 has an elongated cylindrical shape and a step 51 formed inside it and two respective threaded coupling sections 52 and 53. The first internal hollow member 50 is further equipped with a circular upper sealing projection 54. The second internal hollow member 55 has a cylindrical shape and is equipped in its upper part with a recess 56 for insertion of the means for removing the closure $1_6$ and is equipped in its lower part with a threaded section 57 adapted to cooperate through engagement wit the corresponding threaded section 52 of the first internal hollow member 50; moreover, the second internal member 55 abuts against the first internal member 50 on the shoulder of the step 51 in order not to excessively penetrate into the first member 50. Finally, the third internal hollow member 58 is almost completely threaded in 59 in order to cooperate through engagement with the respective threaded section 53 of the first internal member 50, and is equipped with a lower flat part 60 that performs sealing and barrier functions for the closure $1_6$, being oriented toward the container interior. In the arrangement in FIG. 8, the covering body $5_6$ is applied outside the three internal hollow members 50, 55, 58, while, inside, the closure $1_6$ remains equipped with a hollow cylindrical recess 61 into which the means for removing the closure $1_6$ will penetrate.

Figure 9:
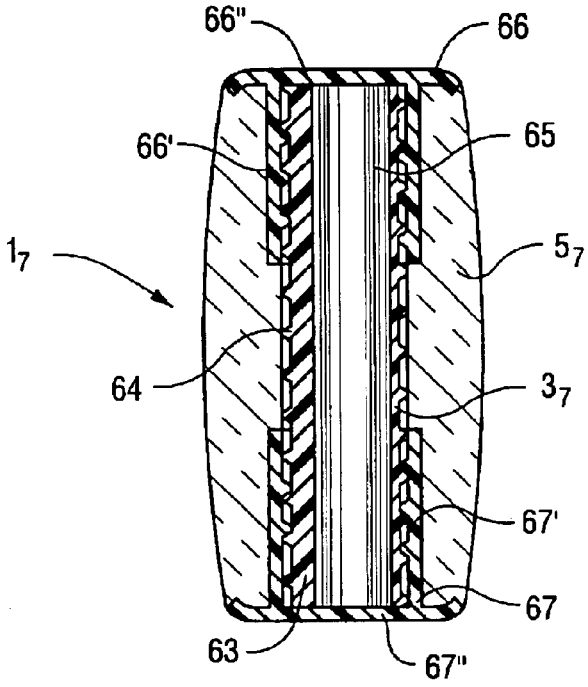
FIG. 9 is a side cross-sectional view of a seventh embodiment of a closure for containers according to the present invention.

According to a seventh preferred embodiment of the invention, shown in FIG. 9, the supporting arid sealing means $3_7$ are composed of a bearing member 63 having a substantially elongated cylindrical shape, that is externally threaded in 64 all along its length and is internally equipped with a plurality of ribs 65 for engaging with the means for removing the closure $1_7$, around such bearing member 63 are screwed a first closure member 66 and a second closure member 67 that are identical and are composed of an internally threaded cylindrical body 66', 67' closed at one end by a circular flat cover 66", 67" with its external edges bent slightly inwards. After the first and the second closure members 66, 67 have been screwed onto the bearing member 63, the covering body $5_7$ is applied so that it covers the three members 63, 66, 67 and is contained inside the bent edge of the covers 66", 67". The closure $1_7$ of this arrangement likewise does not have an upper and a lower part, but can be used under any desired vertical orientation.

Figure 10:
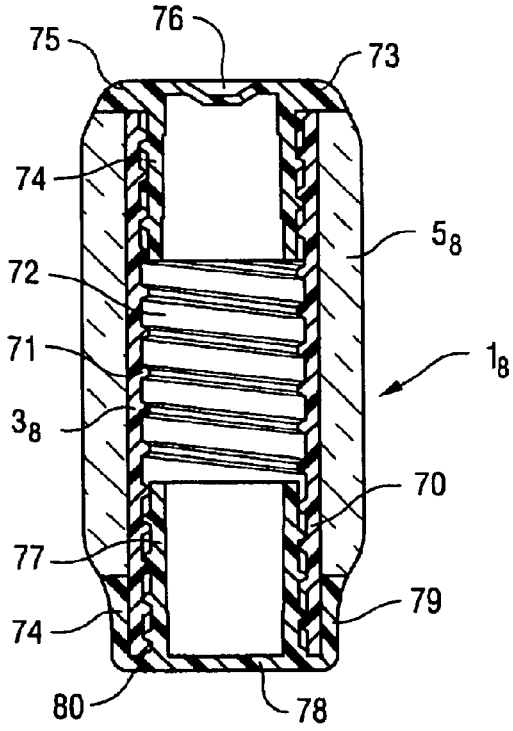
FIG. 10 is a side cross-sectional view of an eighth embodiment of a closure for containers according to the present invention.

According to an eighth preferred embodiment of the invention, shown FIG. 10. the supporting and sealing means $3_8$ are composed of a bearing member 70 having a substantially elongated cylindrical shape, that is internally threaded in 71 all along its length and is internally equipped with a cylindrical threaded structure 72 that is screwed inside it and that helps in further reinforcing it. Inside this bearing member 70 are screwed an upper closure member 73 and a lower closure member 74. The upper closure member 73 is equipped with a cylindrical threaded body 74 that is screwed inside the bearing member 70 and that is overlapped by a cover 75 containing a recess 76 for insertion of the means for removing the closure $\mathbf{1}_8$. The lower closure member 74 is composed of a cylindrical threaded body 77 adapted to be screwed inside the bearing member 70, and a circular flat lower cover 78 with flarings 79 for insertion into the container opening; in this case, however, the lower closure member 74 is shaped in such a way as to form a circular recess 80 between cylindrical body 77 and cover 78: the recess 80 is adapted to house an end of the bearing member 70 to increase the sealing and strength of the supporting and sealing means $\mathbf{3}_8$ as a whole. In this arrangement, after having produced the supporting and sealing means $\mathbf{3}_8$ by coupling their various components, the covering body $\mathbf{5}_8$ is expanded in order to surround them, leaving the covers 75 and 78 outside.

Figure 11:
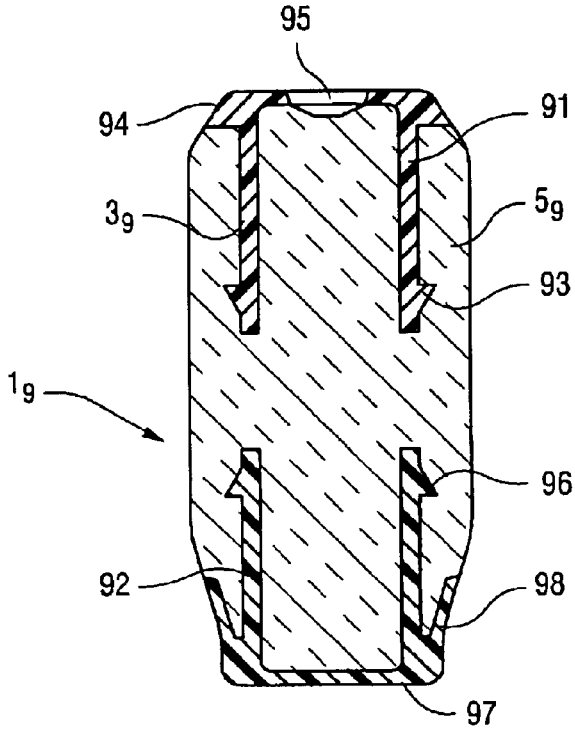
FIG. 11 is a side cross-sectional view of a ninth embodiment of a closure for containers according to the present invention.
Figure 13:
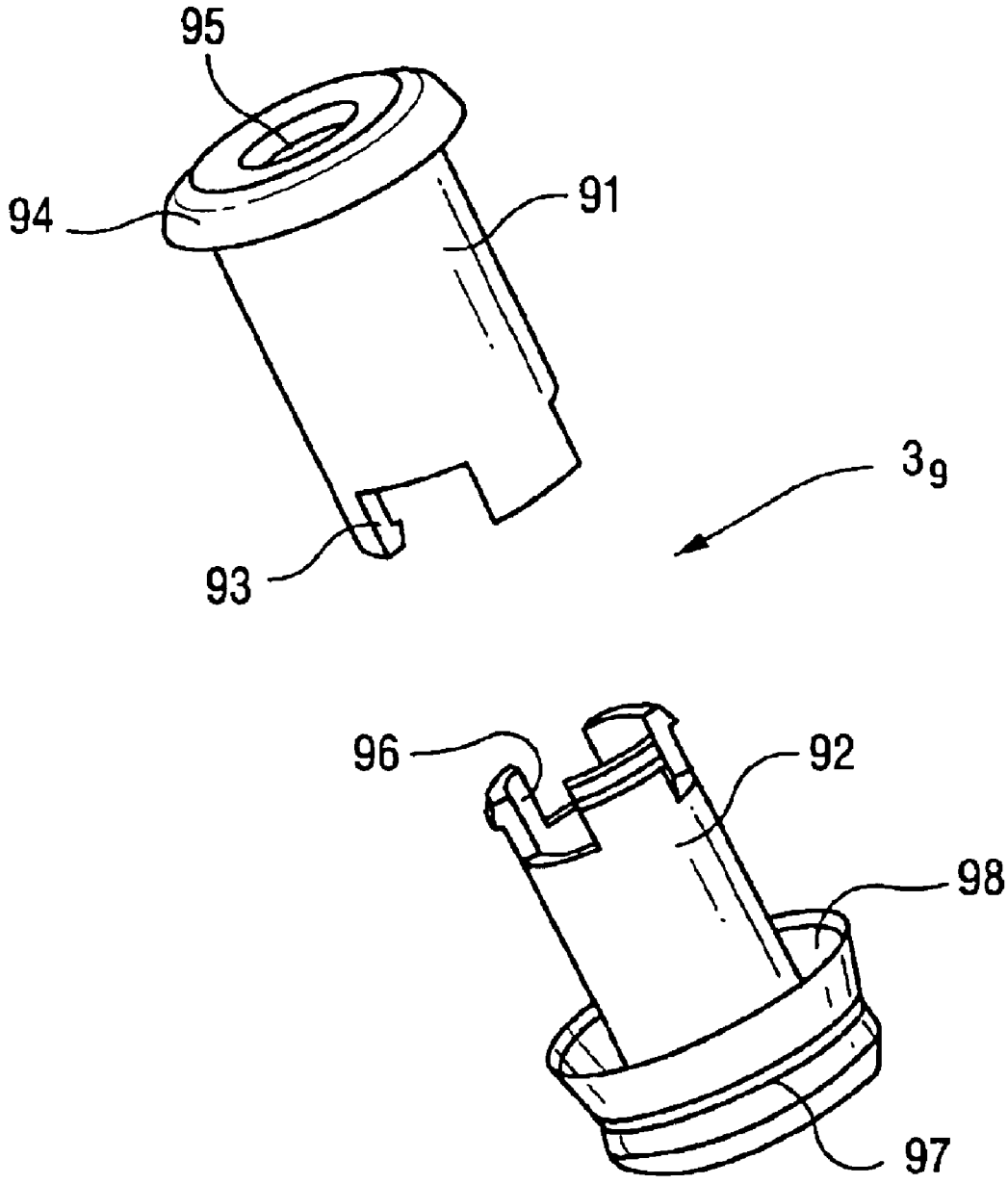
FIG. 13 is a perspective view of the supporting and sealing means of the closure in FIG. 11.

According to a ninth preferred embodiment of the invention, shown in FIGS. 11 and 13, the supporting and sealing means $\mathbf{3}_9$ are composed of an upper closure member 91 and a lower closure member 92. The upper closure member 91 is composed of a hollow cylindrical body equipped at one of its ends with a plurality of small teeth 93 and at the opposite end with a cover 94 having a recess 95 for insertion of the means for removing the closure $\mathbf{1}_9$. The lower closure member 92 is composed of a hollow cylindrical body equipped at one of its ends with a plurality of small teeth 96 and at the opposite end with a circular flat cover 97 equipped with a circular collar 98 adapted to contain the material of the covering body $\mathbf{5}_9$. The covering body $\mathbf{5}_9$ is expanded around the two closure members 91 and 92 in order to surround their respective cylindrical bodies and to engage their respective small teeth 93 and 96, penetrating into the recess 98 and leaving only the covers 94 and 97 outside.

Figure 12:
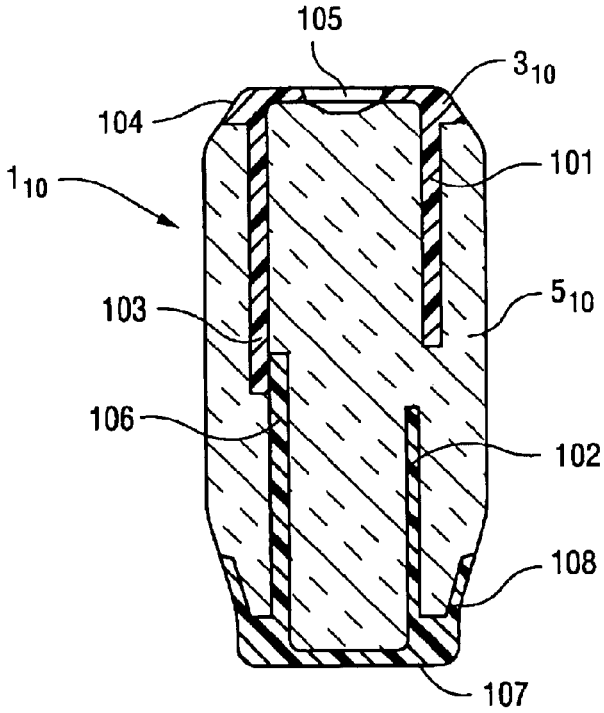
FIG. 12 is a side cross-sectional view of a tenth embodiment of a closure for containers according to the present invention.

Moreover, according to a tenth preferred embodiment of the invention, shown in FIG. 12, the supporting and sealing means $\mathbf{3}_{10}$ are composed of an upper closure member 101 and a lower closure member 102. The upper closure member 101 is composed of a hollow cylindrical body equipped at one of its ends with a tooth 103 and at the opposite end with a cover 104 having a recess 105 for insertion of the means for removing the closure $\mathbf{1}_{10}$. The lower closure member 102 is composed of a hollow cylindrical body equipped at one of its ends with a tooth 106 and at the opposite end with a circular flat cover 107 equipped with a circular collar 108 adapted to contain the material of the covering body $\mathbf{5}_{10}$. The supporting and sealing means $\mathbf{3}_{10}$ in this case receive an internal reinforcement from the mutual coupling of the two teeth 103 and 106. The covering body $\mathbf{5}_{10}$ is expanded around the two closure members 101 and 102 in order to surround their respective cylindrical bodies, penetrating into the recess 108 and leaving only the covers 104 and 107 outside.

Figure 14:
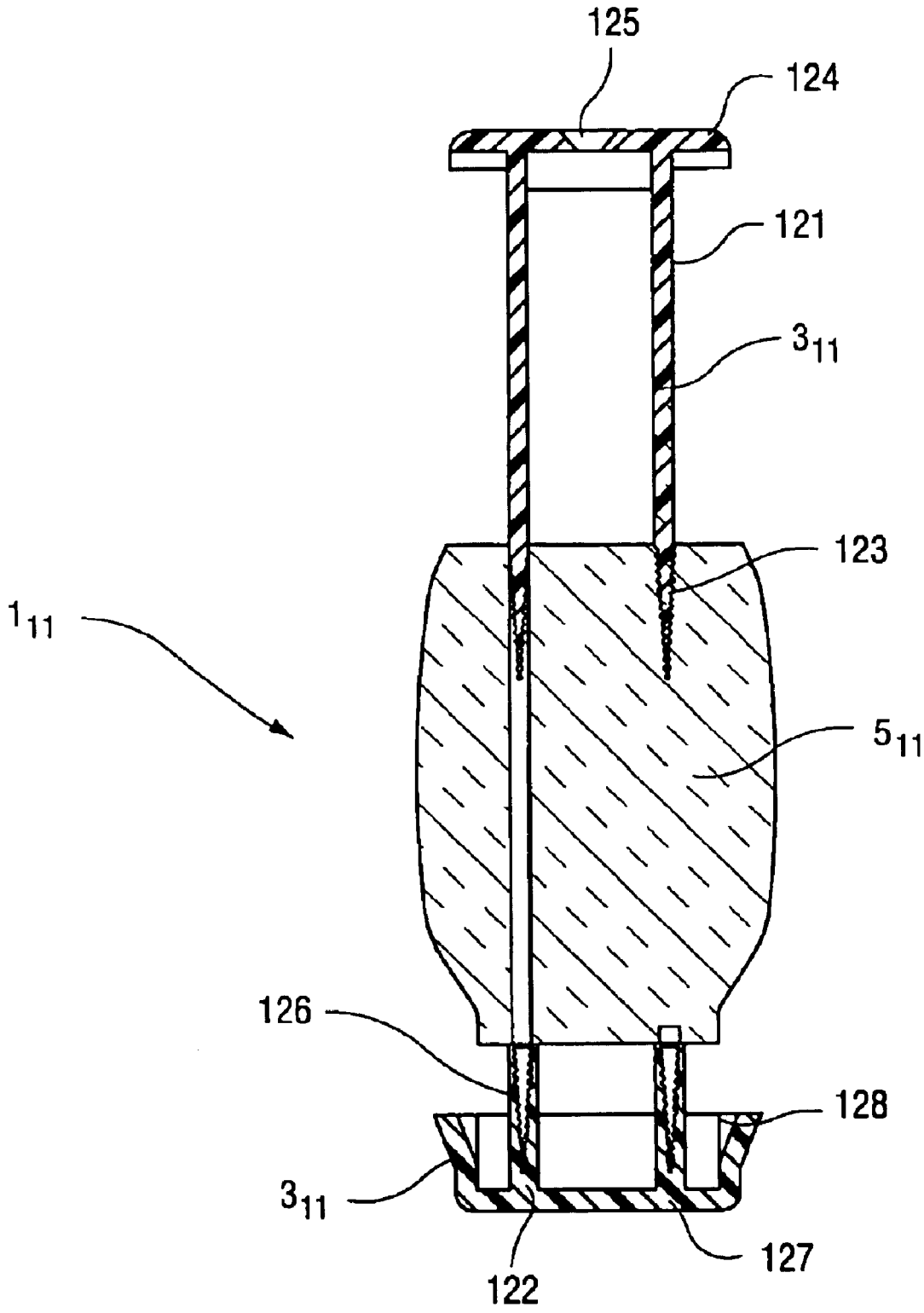
FIGS. 14 to 16 are side cross-sectional views of an eleventh embodiment of a closure for containers according to the present invention.
Figure 15:
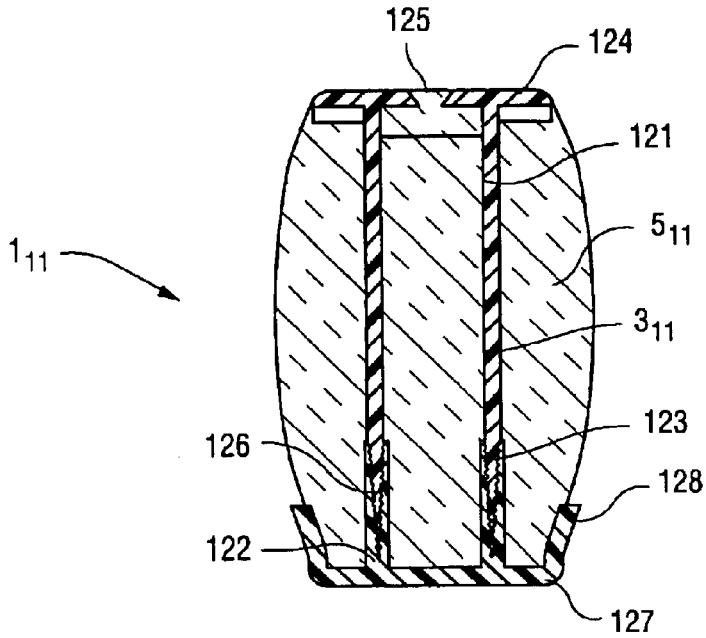
Figure 16:
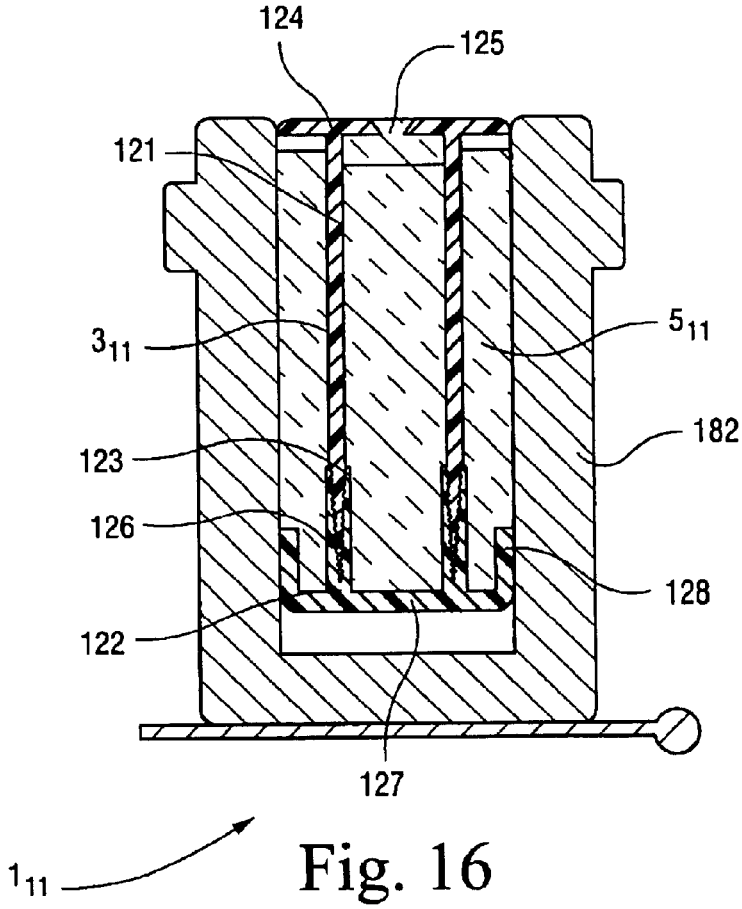

According to an eleventh preferred embodiment of the invention, shown in FIGS. 14 to 16, the supporting and sealing means $\mathbf{3}_{11}$ are composed of an upper closure member 121 and a lower closure member 122. The upper closure member 121 is composed of a hollow cylindrical body equipped at one of its ends with a threaded or toothed wall 123 and at the opposite end with a cover 124 having a recess 125 for insertion of the removing means for the closure $\mathbf{1}_{11}$. The lower closure member 122 is composed of a hollow cylindrical body equipped at one of its ends with a threaded or toothed recess 126 and at the opposite end with a circular flat cover 127 equipped with a circular collar 128 adapted to contain the material of the covering body $\mathbf{5}_{11}$. The supporting and sealing means $\mathbf{3}_{11}$ in this case are produced through the mutual coupling of the wall 123 and the recess 126 by means of their threads or small teeth. The covering body $\mathbf{5}_{11}$ is expanded around the two closure members 121 and 122 in order to surround their respective cylindrical bodies, penetrating into the recess 128 and leaving only the covers 124 and 127 outside. FIG. 16 shows in detail the coupling between the closure $\mathbf{1}_{11}$ and the mouth 182 of the container (not shown).

Figure 18:
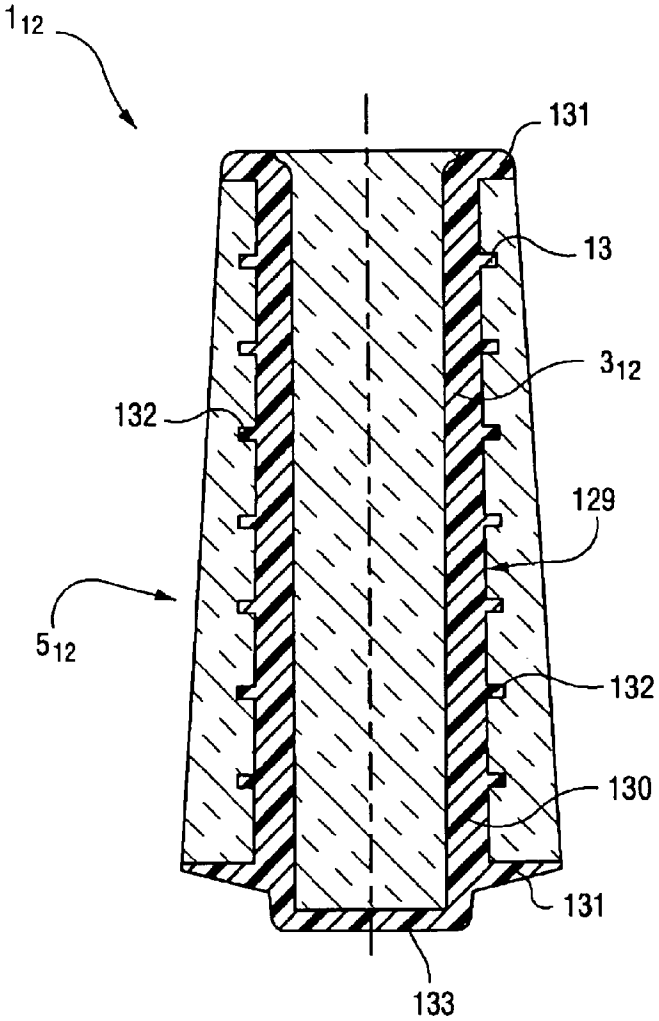
FIG. 18 is a side cross-sectional view of the embodiment in FIG. 17.
Figure 17:
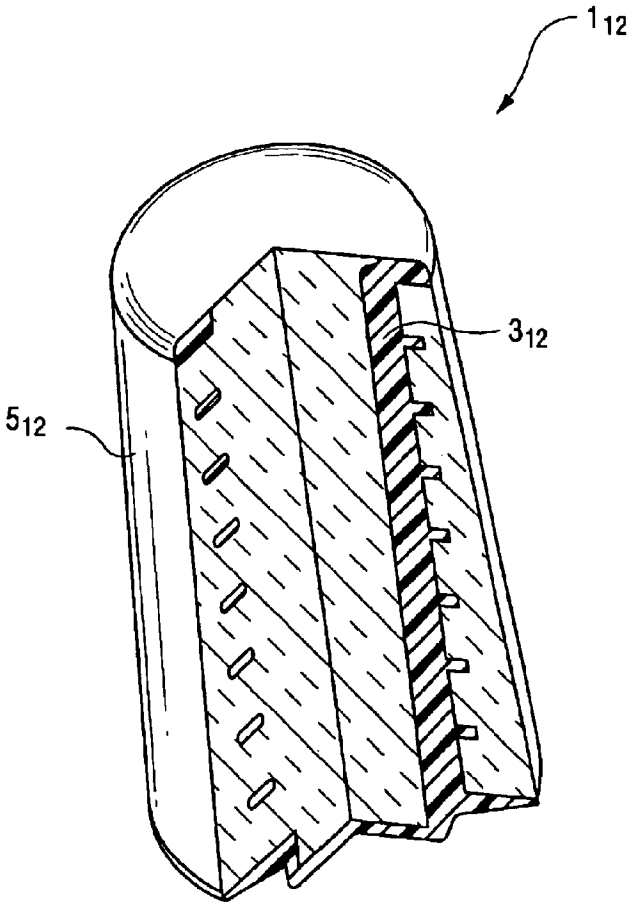
FIG. 17 is a perspective sectional view of a twelfth embodiment of a closure for containers according to the present invention.

In the embodiment shown in FIGS. 17 and 18, the supporting and sealing means $\mathbf{3}_{12}$ are composed of a reinforcing member 129 having a basically cylindrical hollow body 130 terminating at both ends in annular shoulders 131, 131'. The lower annular shoulder 131, which is at the end of the closure $\mathbf{1}_{12}$ designed to be inserted in the neck of the container, is of a larger diameter than the upper shoulder 131'.

On the outer surface of the hollow body 130, between these shoulders 131, 131', is a plurality of annular reliefs 132. These lie in essentially parallel planes and are preferably equidistant from each other. The diameter of said annular reliefs 132 is in general less than that of the shoulders 131, 131'.

The lower end of the hollow body 130 is closed by a base 133, while the upper end remains open.

The covering body $\mathbf{5}_{12}$ is thermoformed directly on said reinforcing member 129, in such a way that the elastomeric material fills the cavity of the hollow body 130 and the external space between the two shoulders 131, 131'. The annular reliefs 132 give the covering body $\mathbf{5}_{12}$ purchase. It is clear therefore that the closure $\mathbf{1}_{12}$ will assume a frustoconical shape, with the larger base designed to be inserted into the neck of the container. This maximizes the seal created by the closure. The fact that the annular reliefs 132 do not extend radially as far as the lateral surface of the covering body $\mathbf{5}_{12}$ further contributes to the seal of the closure and moreover does not spoil the aesthetic appearance of the closure, as clearly shown in FIG. 17.

Another important feature of this embodiment is that the base 133 of the hollow body 130 is oriented toward the interior of the container and therefore gives the closure $\mathbf{1}_{12}$ excellent impermeability to atmospheric oxygen. Meanwhile, the other end of the hollow body 130 is, as stated earlier, open and filled with the elastomeric foam material. This facilitates the insertion of the corkscrew.

Figure 21:
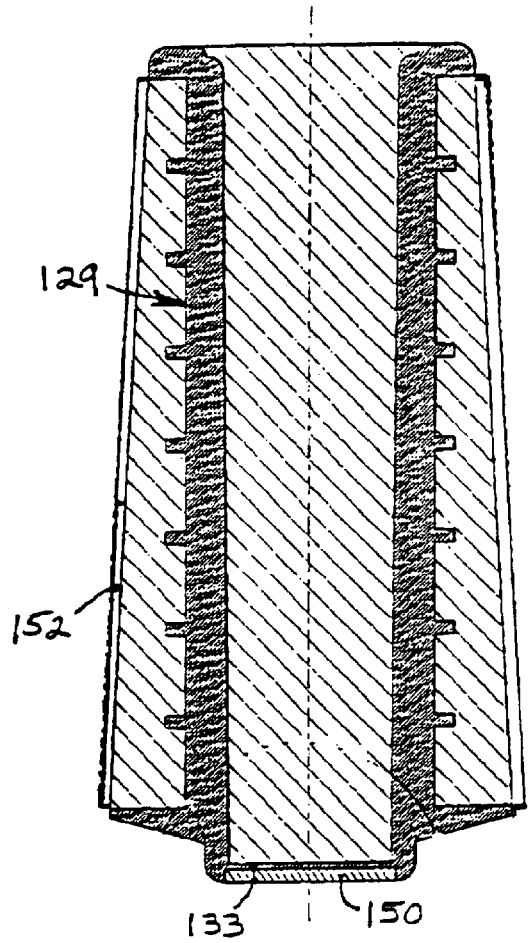
FIG. 21 is a side cross sectional view of a further embodiment of the closure shown in FIG. 18.

FIG. 21 illustrates a further embodiment of the closure of FIG. 18 wherein the base 133 of the reinforcing member 129 is recessed and includes therein a barrier means in the form of a washer 150 formed of a suitable material such as a precious metal or glass. Also, a protective film 152 of any suitable material such as silicone covers the exterior surface of the covering body 5.

Figure 22:
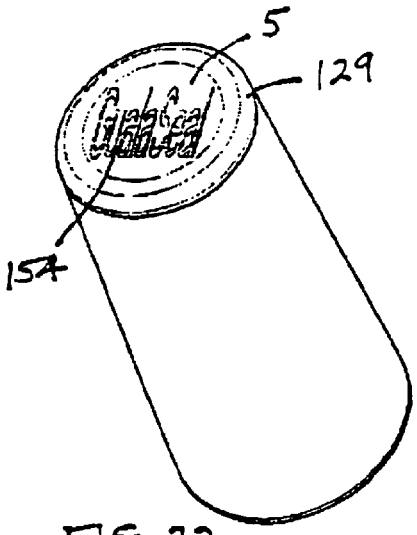
FIG. 22 is a perspective view of a still further embodiment of the closure shown in FIG. 18.

FIG. 22 illustrates a still further embodiment of the closure of FIG. 18 wherein the plastic material of the covering body 5 at the open upper end of the reinforcing member 129 is provided with writing or a sign 154 thereon.

Figure 23:
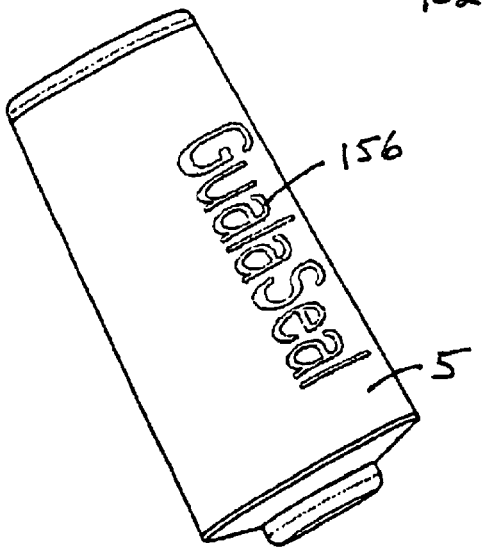
FIG. 23 is a perspective view of another embodiment of the closure shown in FIG. 18.

FIG. 23 illustrates another embodiment of the closure of FIG. 18 wherein laser-marking 156 is provided on the outer surface of the coveting body 5.

Figure 19:
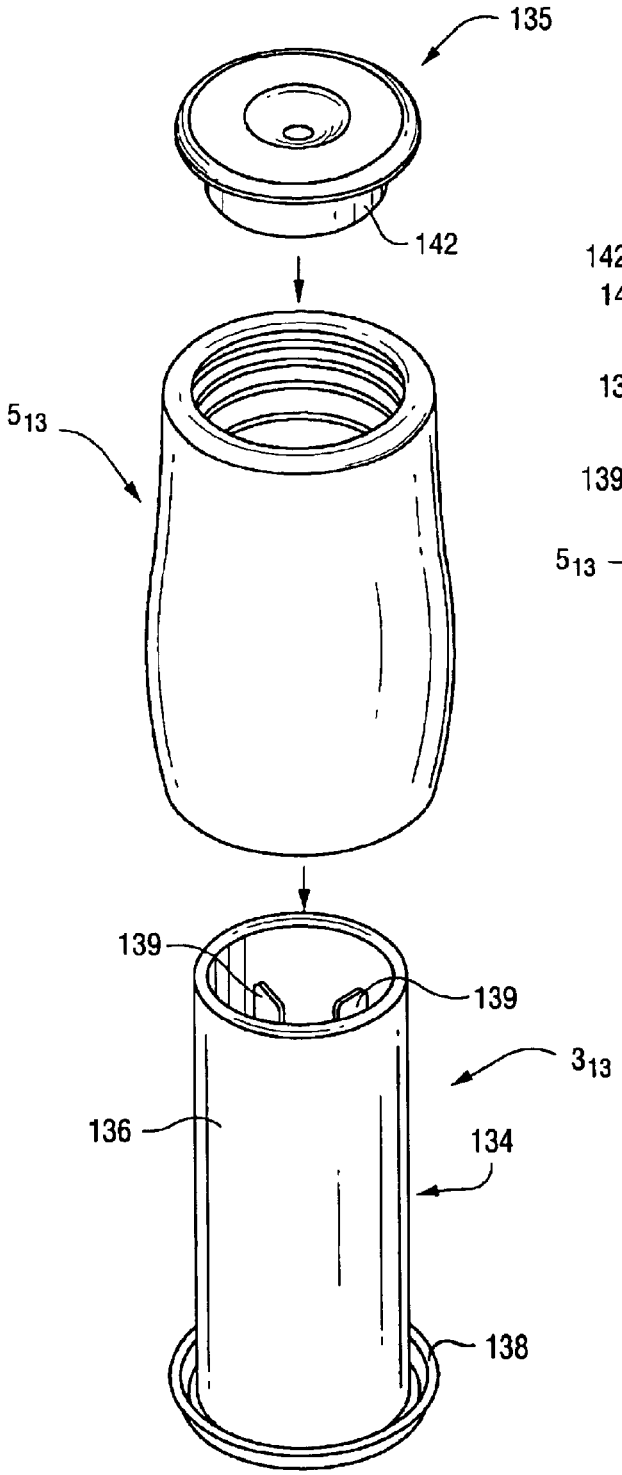
FIG. 19 is an exploded perspective view of a thirteenth embodiment of the closure for containers according to the present invention.
Figure 20:
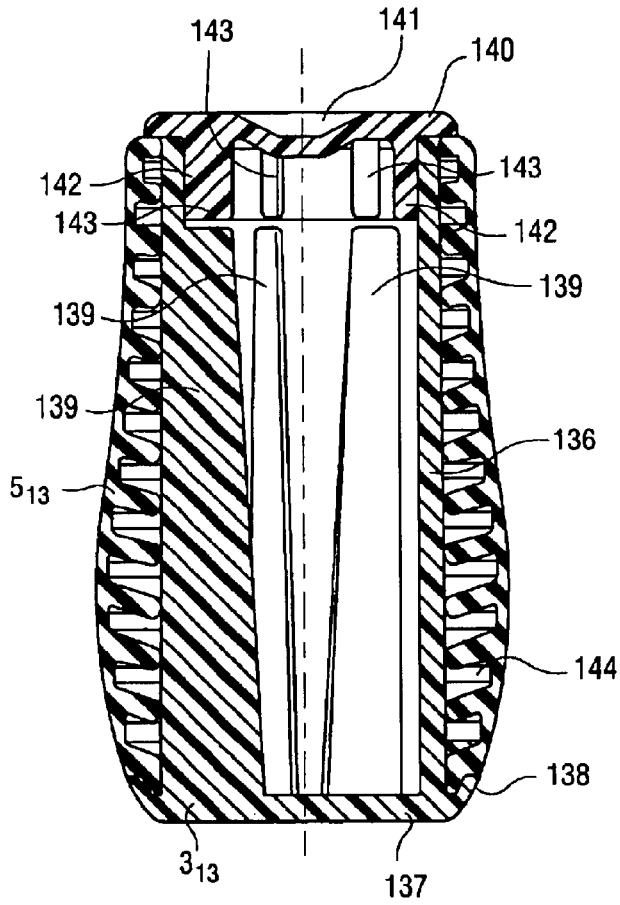
FIG. 20 is a side cross-sectional view of the embodiment in FIG. 19.

In the embodiment shown in FIGS. 19 and 20, the supporting and sealing means $\mathbf{3}_{13}$ are composed of a reinforcing member 134 and a closure member 135. These are coupled together detachably.

The reinforcing member 134 comprises a basically cylindrical hollow body 136 closed at the lower end by a base 137 and open at the upper end. Around the outside of said lower base 137 is an upwardly directed annular profile 138. Inside the hollow body 136 is a plurality of longitudinal fins 139 that extend from the inside surface of the hollow body 136 into the interior. The purpose of these fins 139 is to strengthen the structure and guide the corkscrew as it is inserted, being tapped by the corkscrew as it goes in.

The closure member 135 comprises a disk 140 whose upper surface includes a central depression 141. On the lower surface of said disk 140 is a sleeve 142 whose outside diameter is approximately equal to or slightly less than the inside diameter of the hollow body 136, so that the closure member 135 can be inserted into said hollow body. As with the hollow body 136, a plurality of longitudinal fins is provided on the inside surface of the sleeve 142.

The covering body $\mathbf{5}_{13}$ is of basically cylindrical form, but with an outward swelling to maximize the seal formed by the closure. The interior is hollow and its surface has ribs 144 lying in planes perpendicular to the axis of the covering body 5. This covering body 5 is pushed onto the hollow body 136, and then the closure member 135 is inserted on top of that. In this way the covering body $\mathbf{5}_{13}$ is held between the annular profile 138 and said closure member 135. The ribs 144 encourage the compression of the material and its elastic return, which means that the covering body can be made from a wide variety of different materials, such as, besides those described earlier, silicone, in particular an LSR (Liquid Silicone Rubber, preferably a two-component LSR.

As will appear evident to a person skilled in the art from the above description of some preferred embodiments of the invention, what has been shown and described must obviously be considered as a non-limiting example of the scope of the present invention as defined in the attached claims. In fact, numerous variations of the abovementioned embodiments are possible, through a simple combination of the various members shown or by designing new members performing the same functions of support, seal, barrier and covering of the fundamental members of which the closure 1 of the present invention is composed.

Finally, as further particularity, all closures 1 of the invention, both the abovementioned closures and others that could be easily developed, by a person skilled in the art upon reading the present specification, can be further strengthened by providing their coating with a protective film placed all around them, where in particular the protective film could be a silicone film.

When it comes to producing labels, drawings or captions on the surface of the closure according to the invention, according to the invention, the invention allows the use of laser-based methods in addition to the normal technologies of ink printing. The type of laser and the amount of energy required for this marking process will depend on the plastic material being marked. For the material used in the closures of the present invention it will usually be preferred to use an Nd:YAG laser having a power of 30 to 200 Watts and a wavelength of 1064 nm (secondary waves 531–355–266 nm). The plastic material of which the plug is composed must be treated with a color-changing master that changes coloration when struck by the laser beam. A preferred master is SARMATENE® from Clariant. The color-changing master is added in quantities of between 1% and 4%, preferably approximately 2T. The choice of a laser-marking method involving the use of a color-changing master, instead of laser processes where the marking is produced by surface carbonization, is fundamental because in the case of a closure for containers in which leaktightness of the container is essential, marking by surface carbonization leads irremediably to unacceptable surface irregularities. These surface irregularities would then prevent compliance with the inside surface of the neck of the container as required for an airtight closure.

What is claimed is:

1. A closure for containers having an opening, comprising:

substantially rigid supporting and sealing means for insertion in a container opening, said supporting and sealing means comprising a substantially cylindrical hollow body having an open upper end and a closed lower end, and first and second outwardly extending generally annular shoulders at said upper and lower ends, respectively; and a covering body made of flexible and resilient plastic material, said covering body covering at least a portion of and being connected to said supporting and sealing means, and being adapted to close the container opening when said closure is inserted therein;

said plastic material filling the interior cavity of said hollow body and extending between said first and second shoulders, whereby said covering body is supported in a longitudinal direction by said shoulders to prevent elongation of the plastic material.

2. The closure for containers as claimed in claim 1, characterized in that said covering body is made of an elastomeric material.

3. The closure for containers as claimed in claim 1, characterized in that said covering body is adapted to cooperated by interference with the container opening to prevent the product contained therein from leaking out and to prevent gases and/or foreign substances from entering inside the container.

4. The closure for containers as claimed in claim 1, characterized in that said covering body is made of thermoplastic foam material.

5. The closure for containers as claimed in claim 1, characterized in that said covering body is made of thermosetting foam material.

6. The closure for containers as claimed in claim 1, characterized in that said covering body is made of crosslinked foam material.

7. The closure for containers as claimed in claim 1, characterized in that said closure is a plug for containers for foodstuff.

8. The closure for containers as claimed in claim 7, characterized in that said plug is adapted to close bottles containing beverages.

9. The closure for containers as claimed in claim 8, characterized in that said plug is adapted to close bottles containing alcoholic beverages, in particular wine.

10. The closure for containers as claimed in claim 7, characterized in that said plug is adapted to be placed onto a bottle, in order to close it, using an ordinary plugging machine, and is adapted to be removed from a bottle, when opening it, using ordinary plug removing means.

11. The closure for containers as claimed in claim 10, characterized in that said plug removing means are a corkscrew.

12. The closure for containers as claimed in claim 1, characterized in that said closure has gas-barrier characteristics, preventing gases from penetrating inside the container, and characteristics ensuring a lack of leakages of the closure material into the container, said barrier and lack-of-leakage characteristics being guaranteed for a period that is not less than the one that can be obtained with a closure made of cork.

13. The closure for containers as claimed in claim 12, characterized in that it is further equipped with barrier means on the closed lower end of said hollow body facing the container interior to provide a barrier to the atmosphere surrounding the container.

14. The closure for containers as claimed in claim 13, characterized in that said barrier means are composed of at least one thin layer.

15. The closure for containers as claimed in claim 14, characterized in that said at least one thin layer is made of a precious metal.

16. The closure for containers as claimed in claim 13, characterized in that said barrier means are composed of at least one disk made of glass.

17. The closure for containers as claimed in claim 1, characterized in that said second annular shoulder (131) has a larger diameter than said first shoulder (131') such that said closure is frustoconical in shape, and a plurality of annular reliefs (132) being situated on the outer surface of said hollow body (130) and being covered by said plastic material.

18. The closure for containers as claimed in claim 4, in which said thermoplastic foam material is made by a hot-molding process involving the use of a fluid in the supercritical state as a blowing agent.

19. The closure for containers as claimed in claim 18, in which said fluid is nitrogen in the supercritical state.

* * * * *